United States Patent [19]

Wada

[11] Patent Number: 4,611,904

[45] Date of Patent: Sep. 16, 1986

[54] CONTROL SYSTEM FOR A COPYING MACHINE

[75] Inventor: Kanji Wada, Toyokawa, Japan

[73] Assignee: Minolta Camera Kabushiki Kaisha, Osaka, Japan

[21] Appl. No.: 591,441

[22] Filed: Mar. 20, 1984

[30] Foreign Application Priority Data

Mar. 24, 1983 [JP] Japan ..... 58-49319

[51] Int. Cl.[4] ..... G03G 15/00

[52] U.S. Cl. ..... 355/14 SH; 355/3 SH; 355/26; 271/265

[58] Field of Search ..... 355/3 SH, 14 SH, 14 R, 355/50, 51, 23, 24, 26; 271/265, 4, 275, 3.1, 3

[56] References Cited

U.S. PATENT DOCUMENTS

| | | | |
|---|---|---|---|
| 3,960,446 | 6/1976 | Ogawa et al. | 355/14 SH |
| 4,062,061 | 12/1977 | Batchelor et al. | 355/14 R |
| 4,078,787 | 3/1978 | Burlew et al. . | |
| 4,113,374 | 9/1978 | Nakamura et al. . | |
| 4,264,188 | 4/1981 | Tomosada et al. | 355/14 R |
| 4,313,673 | 2/1982 | Wartinger et al. . | |
| 4,383,756 | 5/1983 | Hanamoto et al. | 355/3 SH |

*Primary Examiner*—Arthur T. Grimley
*Assistant Examiner*—David Warren
*Attorney, Agent, or Firm*—Price, Gess & Ubell

[57] ABSTRACT

The present invention relates to a control system for a copying machine that permits the copying machine to be started by the insertion of manually fed copying paper. The copying machine can further operate with an automatic document feeder that is also operated in conjunction with the manual feeding of copying paper.

6 Claims, 8 Drawing Figures

CONTROL SYSTEM FOR A COPYING MACHINE

BACKGROUND OF THE INVENTION

1. Field of the Invention

The present invention relates to a control system for a copying machine having a manual paper feeder for manually feeding copy paper, and more particularly to a control system for controlling a manual copy paper feeder and a document feeder that can be associated therewith.

2. Description of the Prior Art

When an electrophotographic copying machine or the like is operated with manually fed copy paper, the copy paper must usually be inserted into a paper inlet for every copying cycle in addition to the replacement of the original documents on the document support glass plate. This procedure is cumbersome compared to an automatic paper feed mode wherein copies are made solely by depressing the print key after positioning the original document. With most copying machines, the location where the original document is placed is usually different than the location where the copy paper is inserted manually. This procedure results in low efficiency when copies are produced with manually fed copy paper and increases the burden on the operator.

Thus there is a need in the prior art to provide a new control system for coordinating automatic document feeding and manual copy paper insertion.

SUMMARY OF THE INVENTION

A main object of the present invention is to provide a control system for a copying machine that is capable of controlling a manual copy paper feeder and an automatic document feeder in operative relationship to each other to assure an efficient copying operation when copy paper is inserted manually.

Another object of the present invention is to provide a control system for use in a copying machine operable in association with a document feeder which is adapted to transport a sheet document to a predetermined fixed position on the document support glass plate of the copying machine, to discharge the document upon completion of the copying operation and to transport the next document onto the glass plate, the control system being operable to initiate the document feeder into operation when it detects the manual insertion of copy paper to thereby eliminate the cumbersomeness involved in the replacement of the document or the like during a manual feed copying operation.

Stated specifically, a copying machine is provided with a document feeder attached to the main body of the copying machine and a manual paper feeder for transporting manually inserted copy paper into the copying machine. The copying machine has its operation controlled in an operative relationship with the document feeder in order to cause the document feeder to transport an original document to a predetermined copy position on a document support glass plate that is provided at the top of the copying machine and to stop the document at the copy position and to thereafter cause a scanning means of the copying machine to scan the stopped document. The present invention provides a control system which includes means for detecting the document feeder when mounted to the main body of the copying machine; means for checking whether a document is set in the document feeder; manual insertion detecting means for detecting insertion of copy paper into the manual feeder; and control means for controlling the document feeder to initiate the document feeder into operation upon the detection of insertion of the copy paper by the manual insertion detecting means when the document set in the document feeder is detected by the checking means and for controlling the copying machine to bring the machine into operation upon the detection of insertion of the copy paper by the manual insertion detecting means when the document feeder is not mounted on the machine main body.

BRIEF DESCRIPTION OF THE DRAWINGS

FIGS. 5*a*-1, 5*a*-2 and 5(*b*) are flowcharts showing the control process to be executed by a second CPU.

DETAILED DESCRIPTION OF THE INVENTION

Figure 1:
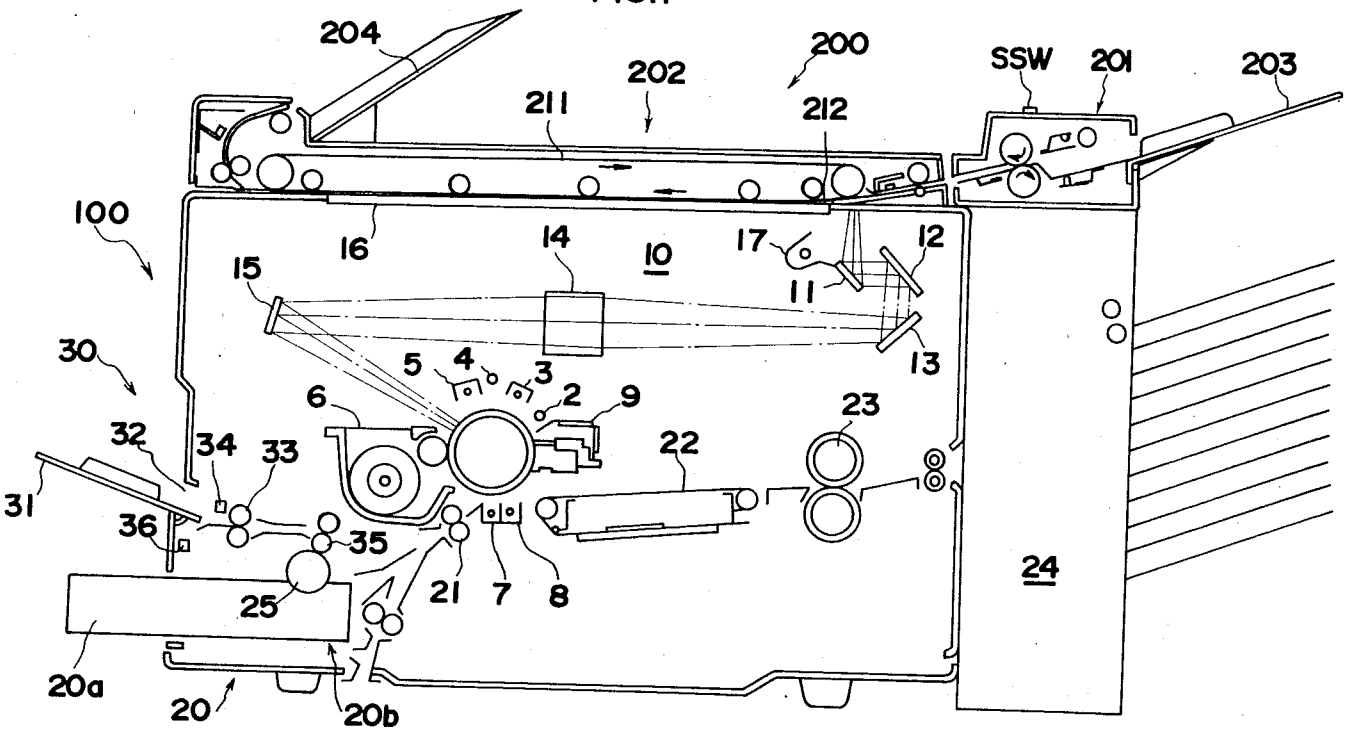
FIG. 1 is a cross-sectional schematic view showing a copying machine and a document feeder in which the present invention is applied.

With reference to FIG. 1, the construction and operation of a copying machine which has a manual paper feeder and which is operable in at least one mode associated with a document feeder will now be described.

A copying machine 100 includes a photosensitive drum 1 which is supported approximately at the central portion in its main body and is rotatable counterclockwise in the view of FIG. 1. Arranged respectively around the drum 1 are a main eraser lamp 2, a subcharger 3, a suberaser lamp 4, a main charger 5, a developing unit 6, a transfer charger 7, a separating charger 8 and a cleaner 9. The photosensitive drum 1 has a photosensitive surface layer which can be sensitized by passing by the eraser lamps 2, 4 and the chargers 3, 5 and can be subsequently exposed to an optical image by a scanning optical system 10, whereby an electrostatic latent image is formed on its surface.

An optical system 10, which is disposed below a document support glass plate 16, for scanning the image of a document comprises a light source 17, movable mirrors 11, 12 and 13, a lens 14 and a mirror 15. The light source 17 and the movable mirror 11 are driven to move leftward at a velocity of v/m (wherein m is the magnification of copy) relative to the peripheral velocity v (which is constant irrespective of whether the magnification is 1 or otherwise) of the drum 1, while the movable mirrors 12 and 13 are driven to move leftward at a velocity of v/2 m.

Copy paper can be sent into the copying machine 100 by an automatic paper feeder 20 or a manual paper feeder 30 provided at the left side of the machine main body as shown. The paper can be temporarily stopped by timing rollers 21 and sent into the transfer station as timed with the image formed on the drum 1. The transfer charger 7 transfers the toner image to the paper, which is then subsequently separated from the surface of the drum 1 by the separating charger 8 and fed to a fixing unit 23 by a conveyor belt 22. The image is first fixed to the paper, and is then delivered to a paper sorter 24.

After the transfer of the image, any toner particles and charges remaining on the surface of the drum 1 are removed by the cleaner 9, eraser lamp 2, etc. to prepare the drum 1 for the next copying cycle.

Only one of the automatic paper feeder 20 and the manual paper feeder 30 is selectively used at a time. For the purpose of selecting one of the feeders, a sensor 36 can be used to detect the opening or closing of a manual feed table 31 which can also serve as a guide for the manual insertion of the copy paper. Alternatively, the copy paper, when inserted into a manual feed inlet 32 while the machine is ready for the transport of paper, may be detected by a sensor 34 to drive a manual feed roller 33 and to start a copying operation. Alternatively, a cassette adapted for manual feed may be inserted into a loading station **20*b*, that is provided for the paper cassette 20*a* when used with the automatic paper feeder 20** illustrated, to set the copy machine for a manual feed operation.

In the case of an automatic paper feed mode of operation, a print key PSW (see FIG. 3) for initiating the copying machine 100 into a copying operation is depressed to start the image forming system including the drum 1 and the scanning optical system 10. With the movement of the scanning optical system 10, a paper feed signal is emitted, which activates a paper feed roller 25 to feed copy paper in synchronism with an image forming operation.

In the case of a manual paper feed mode of operation, a sensor 34 detects when copy paper is inserted into the manual feed inlet 32, whereupon the manual feed roller 33 rotates to send the paper into the machine. Simultaneously with this or with a slight time delay, the drum 1 and the scanning optical system 10 are started, for example, when the print key is depressed as above. The manually fed copy paper is temporarily held at the location of a transport roller 35 and then sent into the machine by the transport roller 35 which is rotated in response to the above-mentioned feed signal. It is also possible to depress the print key PSW when the manually fed paper is at rest at the location of the transport roller 35, followed by the same feed operation as in the case with an automatic feed operation. However, when the machine is controlled to initiate a copying operation by the insertion of copy paper, the copying procedure with manual fed can be simplified.

An automatic document feeder (hereinafter referred to as "ADF") 200 is removably mounted on the top of the main body of the copying machine 100. As will be described later, when it is detected that the ADF 200 is installed in place and electrically connected to the machine main body, the ADF 200 and the copying machine 100 are controlled as associated with each other, and the operation mode of the machine 100 is changed to an ADF mode. The ADF mode is such that when a copying start key on the ADF 200 is depressed, the ADF 200 starts to operate with the copying machine 100 held in a standby state, transporting a document from a document tray 203 onto the document support glass plate and stopping the document at a predetermined position, whereupon the ADF 200 provides a start signal to the copying machine 100 to start the foregoing copying operation. When the document has been completely scanned, the machine 100 delivers an operation signal to the ADF 200, which in turn discharges the document onto a discharge tray 204. When the next document is present on the document tray 203 at this time, the document is subsequently transported to the predetermined copy position with the discharge of the preceding document.

Figure 2:
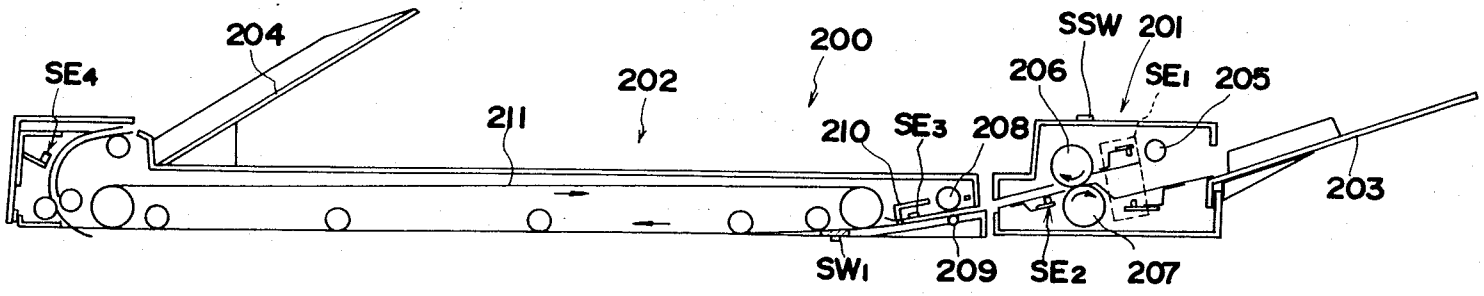
FIG. 2 is a cross-sectional schematic view of the document feeder.

As shown in FIG. 2, the ADF 200 generally comprises a document dispensing unit (A unit) 201 for stacking documents and sending out the documents one by one, and a document feeding unit (DF unit) 202 for transporting the dispensed document as held between the DF unit and the document support glass plate, halting the document in position on the glass plate and delivering the document from the glass plate onto the discharge tray 204. The DF unit 202 is also usable as a manual document feeder. When mounted on the top of the copying machine 100, the DF unit 202 can be opened relative to the main body of the machine 100 to expose the glass plate.

When a detecting switch SWl detects that the A unit 201, the DF unit 202 and the copying machine 100 are mechanically and electrically connected to one another, with the DF unit 202 closed relative to the top of the main body of the copying machine 100, the machine 100 has its operation controlled in the ADF mode, whereby the machine 100 and the ADF 200 are held in an operative relationship to each other.

The ADF 200 is made operable when a document is set on the document tray 203 and detected by a first sensor SE1. The first sensor SE1 comprises, for example, the combination of a light-emitting element and a photocell which are opposed to each other with the tray 203 positioned therebetween. The first sensor can detect the absence of a document when the photocell senses the light from the light-emitting element.

When a start signal is produced with a document set on the tray 203, a document feed roller 205 is driven and also lowered into a pressing contact with the upper surface of the document, whereby the document is advanced. The document is advanced between a forward rotation dispensing roller 206 and a reverse rotation releasing roller 207. Thus the uppermost document only is forwarded toward the DF unit 202. The document forwarded by the dispensing roller 206 is detected by a second sensor SE2, whereupon the feed roller 205 is subsequently lifted out of contact with the document.

When the document is further forwarded to pass between a pair of pinch rollers 208, 209 of the DF unit 202 and is detected by a third sensor SE3, the pinch rollers 208, 209 are pressed against each other, the dispensing roller 206 and releasing roller 207 are stopped and a belt 211 is driven. The pair of pinch rollers 208, 209 are thereafter driven with a slight time delay, and a gate stopper 210 is opened to send out the document. The document is then transported on the upper surface of the glass plate 16 by the belt 211 and stopped a specified period of time after the rear end thereof has passed the third sensor SE3. Subsequently the belt 211 is driven in a reverse direction to bring the rear end of the document into contact with a stopper 212 (see FIG. 1), whereupon the belt stops. The document is now properly positioned for a copying operation.

When the document is stopped on the glass plate 16, the ADF 200 feeds a signal to the copying machine 100 for the starting of a copying operation. When another document is set in the A unit 201 at this time, the document is sent to the gate stopper 210. Upon completion of a scanning movement of the optical system 10 for copying, the copying machine 100 gives a signal to the ADF 200, driving the belt 210 again to transport the document on the glass plate 16 toward the discharge direction. With a predetermined time delay, the pinch rollers 208, 209 are pressed against each other to feed the next document in the same manner as described above. If the copying machine 100 is set in a multicopy mode, the document discharge operation is not started until the scanning movement for the last copy is completed.

Figure 3:
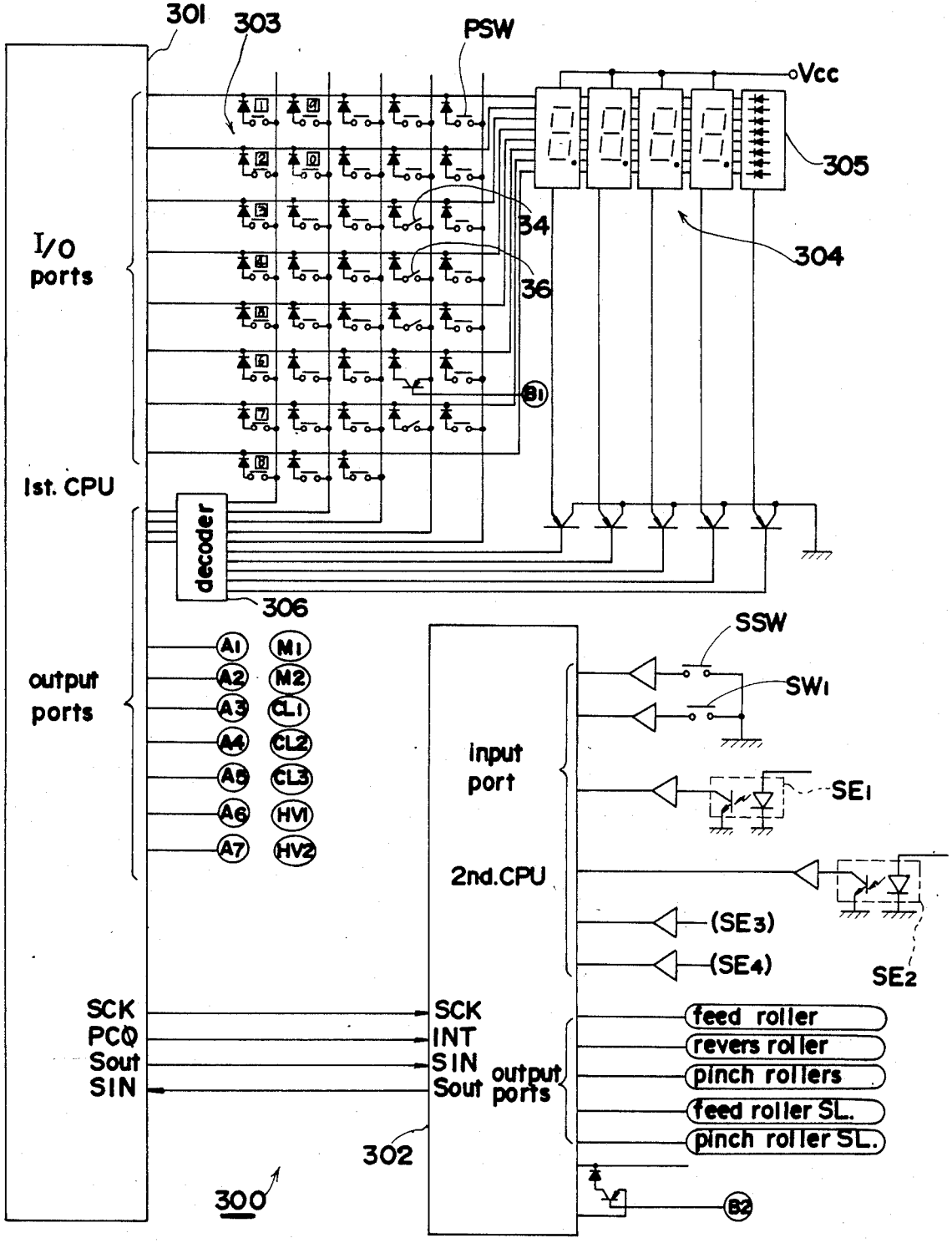
FIG. 3 is a diagram showing a control system of the invention and a circuit including the same.

The copying machine 100 and the ADF 200 having the foregoing construction are associated with a control system 300 including a microcomputer so as to have their operation controlled by a first CPU 301 and a second CPU 302, respectively, as seen in FIG. 3.

The first CPU 301 is connected via a decoder 306 to a key matrix including a ten-key arrangement 303, the print switch PSW, or the switch 36 for detecting opening or closing of the manual feed table, the switch 34 for detecting the manually fed paper, etc., a display 304 for showing the copy number set by the ten-key arrangement 303, and a light-emitting diode 305 for various displays, etc., which are provided on an unillustrated operation panel of the copying machine 100. To control the operation of the copying machine, the first CPU 301 has output ports which are connected to a drive circuit (not shown) for the main motor, developing motor, clutches, chargers, etc. The first CPU 301 further controls the operation of the ADF 200 via an interrupt signal output terminal PCϕ, data input terminal Sin, data output terminal Sout, and data sample and output clock SCK and is connected to the second CPU 302 for transmitting to the first CPU 301 signals relating to the operation of the ADF 200.

The second CPU 302 has input ports connected to a start key switch SSW, the switch SW1 for detecting opening or closing of the DF unit 202 and the first to fourth document sensors SE1 to SE4 and output ports connected to a drive circuit (not shown) for motors for driving the document feed roller 205, forward and reverse rotation motors 206, 207, pinch rollers 208, 209, etc., and to a drive circuit (not shown) for a solenoid for pressing the feed roller 205 into contact with the document and a solenoid for pressing the pair of pinch rollers 208, 209 against each other.

The terminals B1 and B2 shown are adapted to receive motor pulse signals which are generated in a timed relationship with the rotation of the main motor (not shown) of the copying machine 100 and of a motor (not shown) for driving the belt 211 within the DF unit 202, respectively, whereby the mechanical drive is held in synchronism with the control by the CPUs.

Figure 4A:
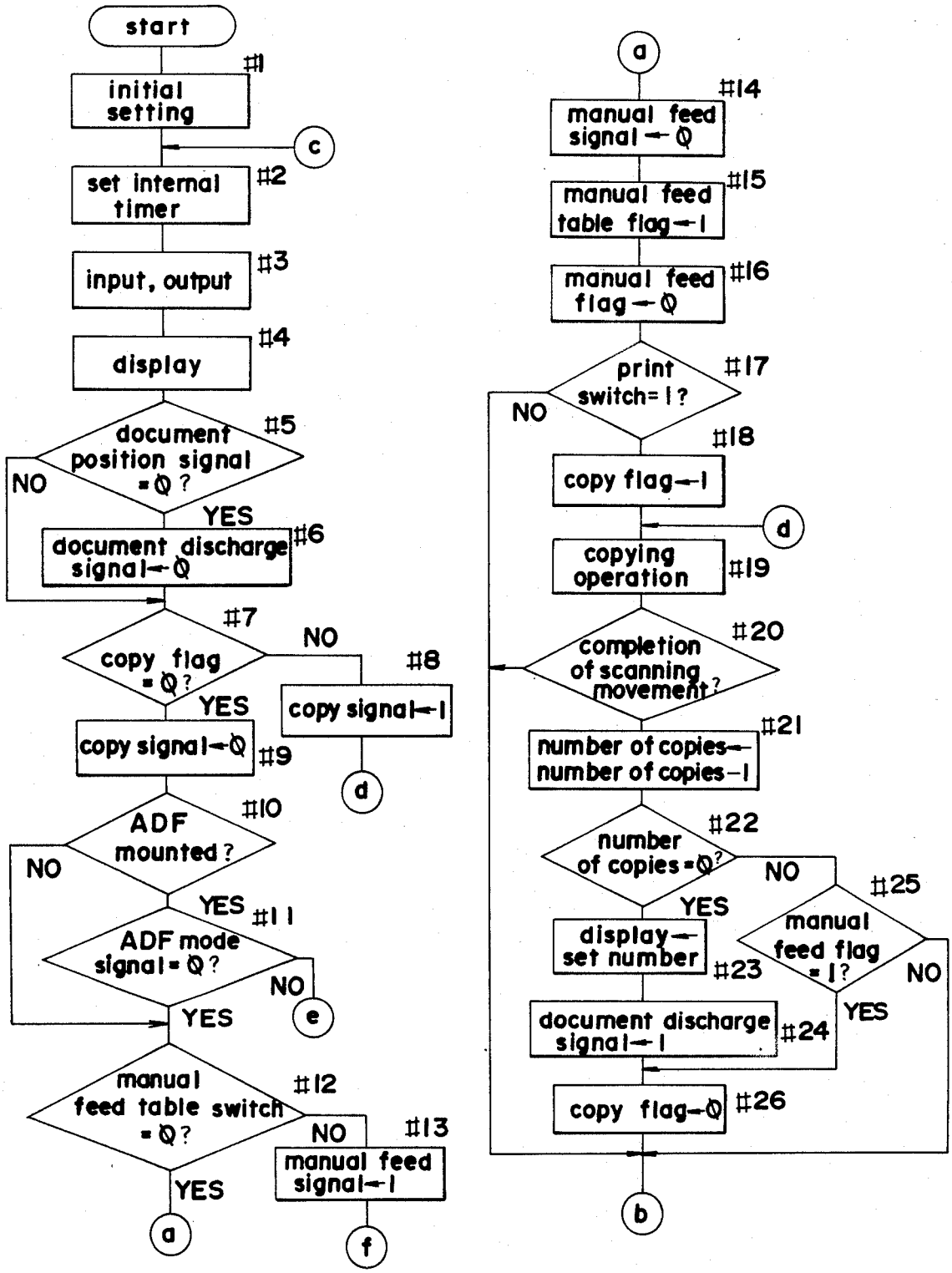
FIGS. 4(*a*) and (*b*) are flowcharts showing the control process to be executed by a first CPU.
Figure 4B:
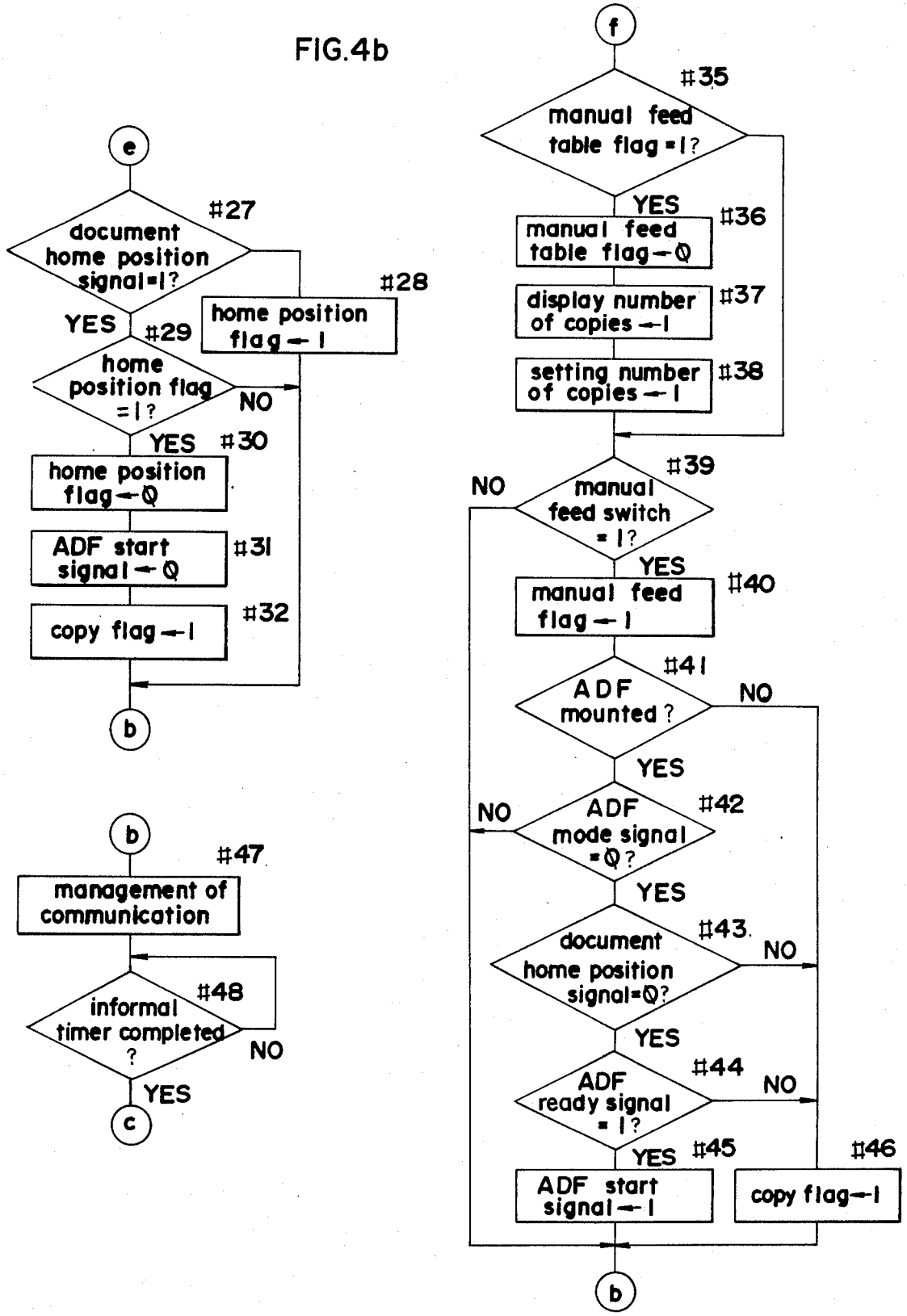
Figures 1, 5A:
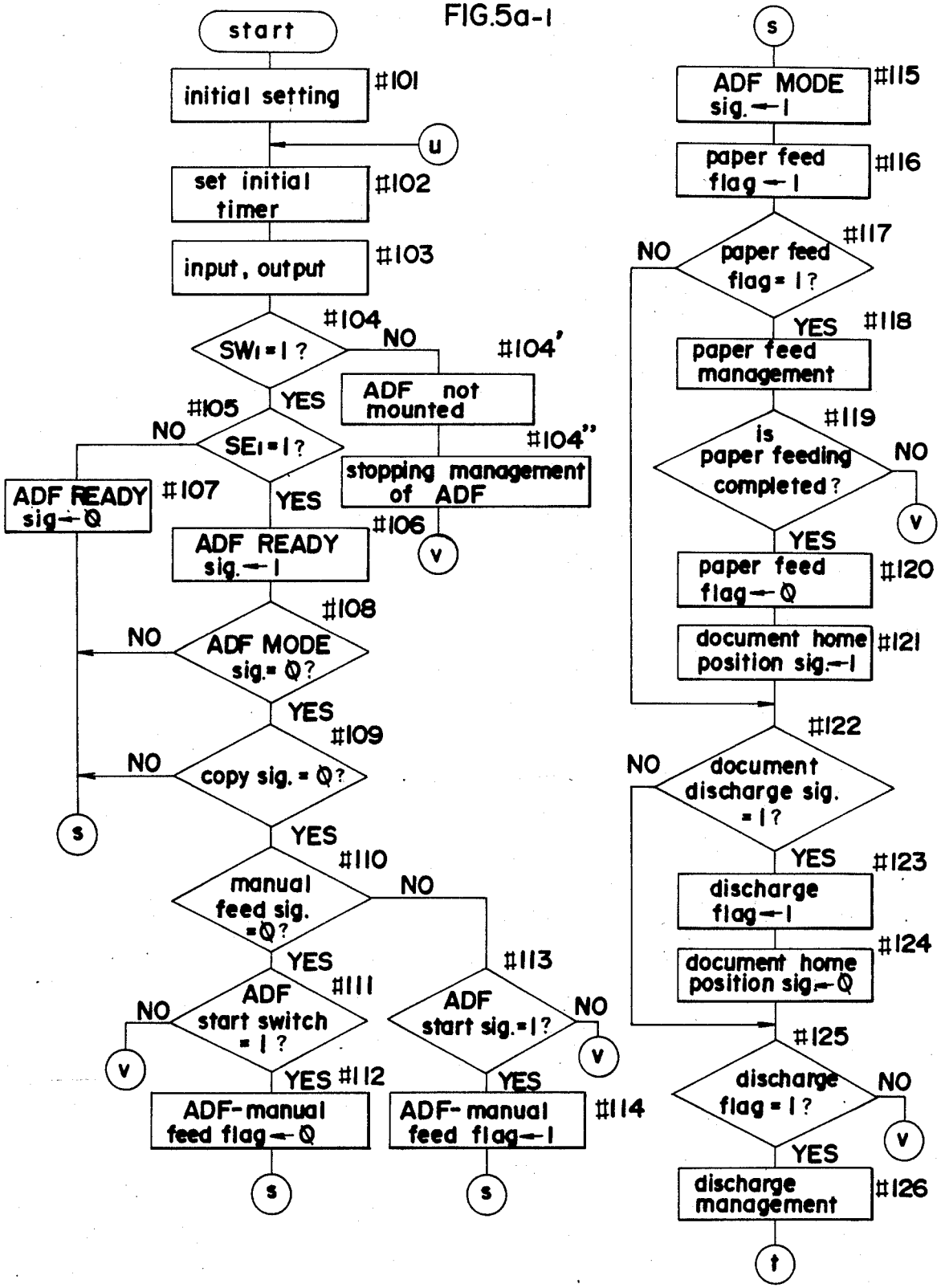
Figures 2, 5A:
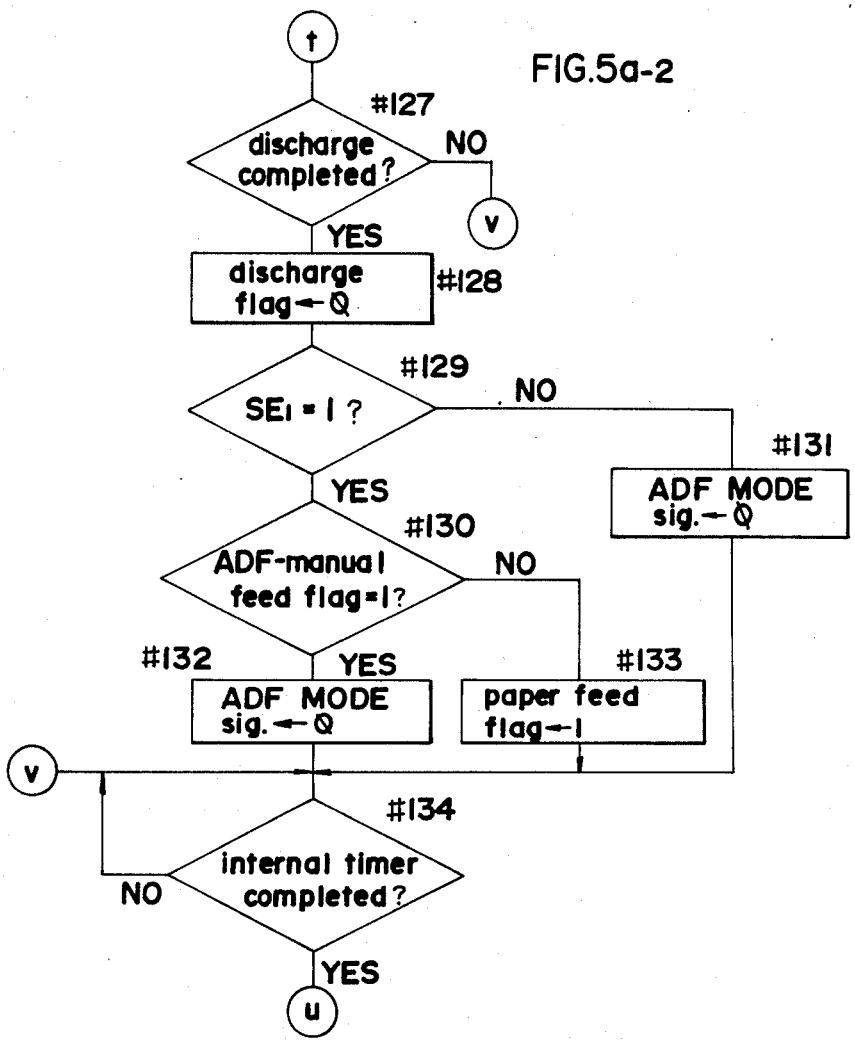
Figure 5B:
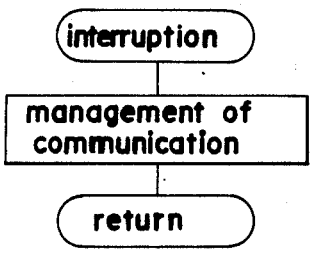

The first and second CPUs 301, 302 thus associated with the copying machine 100 and the ADF 200, execute the processes shown in FIGS. 4 and 5, respectively, while also transmitting signals to each other.

FIGS. 4(*a*) and (*b*) show the process to be executed by the first CPU 301.

When the power supply is turned on, step #1 is performed for initialization, which means setting of the copying machine to standard conditions, such as setting the copy number display 304 to "1", and clearing the RAM, registers, etc., within the CPU. In step #2, an internal timer is set to provide the processing time for the first CPU 301 constant irrespective of what is to be processed.

Steps #3 and #4 are performed for feeding signals to the CPU and delivering signals therefrom and for displaying information to the operator.

Step #5 checks the document position signal received from the second CPU 302 (to be described later). When this signal is "0", i.e., when no document is present in the predetermined position, the document discharge signal to be delivered from the first CPU 301 to the second CPU 302 is made "0", i.e., "OFF", in step #6. As will be described later, the document discharge signal is made "1" when the document on the glass plate 16 is to be discharged. Accordingly, the procedure of steps #5 and #6 means that the document discharge signal is emitted only when document discharge operation is to be started.

Step #7 checks the copy flag. When it is "1", step #8 follows, in which the copy signal to be delivered to the second CPU 302 is made "1". When the flag is "0", the sequence proceeds to step #9, making the copy signal "0". As will be described later, the copy flag becomes "1" with the start of a copying operation and becomes "0" upon the completion of scanning for the last copying cycle.

Step #10 checks whether the ADF 200 is mounted on the copying machine 100. Step #11 checks whether the machine is set in the ADF mode. As will be described later, the ADF mode signal becomes "1" with the start of the ADF 200 (start of feed of document) and becomes "0" on completion of a document discharge operation. The signal is transmitted from the second CPU 302 to the first CPU 301.

When the ADF mode signal is found to be "1" in step #11, step #29 follows. If it is "0", the state of the switch 36 for the manual feed table is checked. Accordingly, while the ADF mode signal is "1", processing for manual feed copying operation is not conducted.

When the switch 36 is found to be "1" in step #12, i.e., when the manual feed table 31 is open, step #13 follows. If the switch 36 is "0", i.e., if the table is closed, step #14 follows. In these steps #13 and #14, the manual feed signal becomes "1" and "0", respectively. The manual feed signal becomes "1" when the manual feed table is found open and is transmitted to the second CPU 302.

The manual feed table flag and manual feed flag are made "1" and "0", respectively, in steps #15 and #16. The manual feed table flag is "1" when the table 31 is closed. It is "0" when the table is open. The manual feed flag is changed to "1" by the start of a manual feed copying operation and to "0" by the closing of the table 31.

Steps #17 to #19 show that a copying operation is started upon depression of the print switch PSW when the copy flag is "0". When the completion of a scanning movement of the scanning optical system 10 is detected during a copying operation in step #20, "1" is subtracted in step #21 from the number of copies shown on the display 304 and stored in suitable memory means, and the copying cycle is repeated until the result of subtraction becomes "0". However, when the copying machine is in the manual feed copying mode with "1" for the manual feed flag (step #25, YES), step #26 follows each copying cycle to make the copy flag "0" to permit a manual insertion of the next sheet of copy paper on completion of a scanning in the manual feed mode. When the result of subtraction becomes "0", the display 304 is caused to restore the initial numerical setting, the document discharge signal to be transmitted to the second CPU 302 is made "1" and the copy flag is changed to "0" in steps #23, #24 and #25. Thus a predetermined number of copies can be obtained from a single document with the use of the ADF 200 even in the case of a manual feed copying operation.

Steps #27 to #32 in FIG. 4(*b*) are executed when the ADF mode signal is found to be "1" in step #11. With reference to the document position signal from the ADF 200, transport of a document to the specified position on the glass plate 16 is detected, whereupon the position flag is changed to "0", the ADF start signal is made "0" and the copy flag is set to "1". Thus, in the ADF mode, a copying operation is automatically started upon completion of the transport of the document to the specified position.

Steps #35 to #46 are executed when the manual feed table 31 is found open in step #12. When the manual feed table 31 is opened, the indication on the display 304 and the copy number setting for the manual feed mode are made "1", and the manual feed table flag is set to "0" in steps #35 to #38. In the case of a manual feed copying operation as in an automatic feed copying operation, the number of copies to be made from a single document can be set by the ten-key arrangement and are shown on the display 304.

Steps #39 to #46 are executed when the manual insertion detecting switch 34 (see FIGS. 1 and 2) is pushed by the leading end of the copy paper inserted manually, whereby when the ADF 200 is not mounted on the machine, a copying operation in the manual feed mode is immediately started. When the ADF 200 is mounted, a signal "1" for starting the ADF 200 is given under the conditions of ADF mode signal="0", document position signal="0" and ADF ready signal="1". The conditions of ADF mode signal="0" and document position signal="0" show that when the machine is in a copying operation in the ADF mode, copying in the ADF manual feed mode is not accepted. The condition of ADF ready signal="1" is an operation start condition required for every copy mode wherein the ADF 200 is used.

For communication with the second CPU 302, the first CPU 301 performs step #47. Upon a request for a communication from the first CPU 301, the second CPU 302 processes data by an interrupt. While the program processing time for the first CPU 301 is set to a constant value by the internal timer irrespective of what is processed, step #48 checks the lapse of the time. The sequence returns to step #2 every time the set time is completed to repeat the foregoing processing routine.

FIGS. 5(*a*) and (*b*) are flowcharts showing the control process to be executed by the second CPU 302 for controlling the operation of the ADF 200. FIG. 5(*b*) shows the procedure to be followed when the above-mentioned interrupt request is made by the first CPU 301 for communication.

With reference to FIG. 5(*a*), steps #101 to #103 correspond to steps #1 to #3 shown in FIG. 4(*a*).

Step #104 checks the state of the switch SW1 for detecting the closing of the DF unit 202 relative to the top of the copying machine 100. If the unit is open, the absence of the ADF 200 in its mounted position is recognized to hold the ADF 200 out of operation, and step #134 follows. Thus, the ADF 200 is held out of operation until the unit 202 is closed.

Step #105 checks the state of the first sensor SE1 to detect whether a document is set in position on the document tray 203. If it is set, step #106 gives an ADF ready signal "1".

Steps #108 and #109 check the ADF mode signal and copy signal. When both are "0", steps #110 et seq. follow. Thus, no ADF start signal is accepted while the machine is in a continued copying operation in the ADF mode and during the movement of the scanning system 10.

Step #110 checks the manual feed signal delivered from the first CPU 301. When the manual feed table 31 is open (manual feed signal="1") with the ADF 200 mounted in position, the sequence proceeds to step #113 to check the ADF start signal. If it is "1", the ADF manual feed flag is set to "1" in step #114. The ADF start signal is a signal which is set to "1" in the foregoing step #45. When the manual feed table 31 is found to be closed (manual feed signal="0") in step #110, indicating that the machine is in the usual ADF mode, step #111 recognizes the closing of the ADF start switch SSW, whereupon the ADF manual feed flag is set to "0" in step #112, followed by step #115. The ADF manual feed flag is set up when manually inserted copy paper is supplied in the ADF mode.

Steps #115 and #116, which are provided for the start of the ADF 200, respectively change the ADF mode signal and paper feed flag to "1".

Steps #117 to #121 are a sequence of control steps for transporting the document and stopping it at the specified position on the glass plate 16 while the paper feed flag is "1". On completion of transport of the document, step #121 changes the document position signal to "1".

Steps #122 to #128 are a series of control steps which are executed when the document discharge signal from the first CPU 301 becomes "1" to thereafter discharge the document. When the document discharge signal becomes "1", steps #123 and #124 change the discharge flag to "1" and the document position signal to "0". Steps #125 and #128 show that the discharge operation is continued while the discharge flag is "1" (until the rear end of the document passes the fourth sensor SE4).

Upon completion of the discharge operation when the ADF mode signal is "1", step #129 checks the state of the first sensor SE1, and steps #129 to #133 are executed as follows in accordance with the result. If the first sensor SE1 is "0", indicating the absence of a document to be transported, the ADF mode signal is changed to "0" to hold the machine in a standby state for the next procedure. When the first sensor SE1 is "1", step #130 checks the ADF manual feed flag. The flag, if "0", indicates the usual copying mode with the use of the ADF 200, so that step #133 changes the paper feed flag to "1" to start the above-mentioned document feed operation. When the manual feed flag is "1", step #132 changes the ADF mode signal to "0" to permit manual insertion of the next sheet of paper, followed by step #134.

Step #134 corresponds to the aforementioned step #48 for the first CPU 301 and is followed by step #102 upon lapse of the time set on the internal timer.

In the processes described above, various conditions permitting a manual feed copying operation are set when the ADF 200 is mounted in position, and the ADF 200 is started upon detection of a manually inserted copy paper when such conditions are fulfilled, as shown by steps #5 to #13 in FIG. 4(*a*), steps #35 to #45 in FIG. 4(*b*) and steps #105 to #116 in FIG. 5(*a*). Accordingly, a manual feed copying operation can be carried out with a high degree of efficiency.

The flowcharts described show a preferred embodiment of the present invention for controlling the operation of the copying machine 100 and ADF 200 shown in FIGS. 1 and 2. The specific construction and operation of the ADF and copying machine, various operating conditions, timing, etc., therefor may be suitably altered or modified within the scope of the technical concept of the invention.

What is claimed is:

1. In a copying machine having a main body that can be connected to a document feeder and a manual paper feeder for transporting manually-inserted copy paper into the copying machine, the copying machine having its operation controlled in an operative relationship with the document feeder so as to cause a start operation in which the document feeder transports a document to a predetermined position on a document support glass which is provided at the top of the copying machine and stops the document at the predetermined position and to thereafter cause a scanning means of the copying machine to scan the stationary document for a copying operation, and to cause an end of the operation wherein the document feeder discharges the document out of the document feeder after the completion of the copying operation for that document, a control system comprising:

a manual insertion-detecting means for detecting the insertion of copy paper into the manual paper feeder;

means for preliminarily setting the number of copies to be reproduced, said number setting means being capable of setting the number of copies when the manual paper feeder is in an operable condition;

means for detecting an agreement between a plural number of copies which are preset by the setting means and the actual number of copy papers detected by the manual insertion-detecting means; and control means for controlling the document feeder to initiate the start operation upon detection of a first insertion of copy paper by the manual insertion-detecting means and to initiate the end of the operation upon detection of an agreement by the agreement-detecting means.

2. A control system as claimed in claim 1, further comprising a first digital computer for controlling the operation of the copying machine and a second digital computer for controlling the operation of the document feeder, said first and second digital computers communicate signals to each other to operate the copying machine and the document feeder.

3. A control system as claimed in claim 1, further comprising means for changing the manual paper feeder from an operable condition to an inoperable condition or vice-versa.

4. In a copying machine having a main body that can be connected to an automatic document feeder and a manual paper feeder for transporting manually-inserted copy paper into the copying machine, the copying machine having its operation controlled in an operative relationship with the document feeder so as to cause the document feeder to transport a document to a predetermined position on a document support glass plate that is provided at the top of the copying machine and to stop the document at the predetermined position and to thereafter cause a scanning document for a copying operation, and to cause an end of the operation wherein the document feeder discharges the document out of the document feeder after the completion of the copying operation for that document, a control system comprising:

means for detecting when the document feeder is mounted in an operative position on the main body of the copying machine and providing an enabling signal;

means for checking whether a document is set in the document feeder and providing an operation signal;

a manual insertion-detecting means for detecting the insertion of copy paper into the manual feeder and providing a start signal;

means for setting the number of copies to be reproduced, said number setting means being capable of setting the number of copies when the manual paper feeder is in an operable condition;

means for measuring the number of copies actually made;

means for determining whether the copy machine should start a copying mode of operation upon the detection of a start signal in the absence of an enabling signal and also to determine whether the copy machine should start a copying mode of operation upon the detection of the start signal in coordination with the presence of the enabling signal and operation signal whereby the copy machine can be automatically operated by the insertion of copy paper both with and without the use of an accessory automatic document feeder; and means for continuing the copy operation until the number of copies actually made correspond to the number of copies set for reproduction regardless of whether the copying machine is in an automatic document feeder mode of operation or in a manual paper feeder mode of operation.

5. A control system as claimed in claim 4, further comprising means for changing the manual paper feeder from an operation condition to an inoperable condition or vice-versa.

6. A control system as claimed in claim 4, further comprising means for starting the end of operation after completion of a copying operation by said continuing means.

* * * * *